US005517722A

United States Patent [19]

Bender

[11] Patent Number: 5,517,722

[45] Date of Patent: May 21, 1996

[54] CURTAIN HOLDER

[76] Inventor: Lillian M. Bender, #2 Shamrock St., Stockbridge, Mass. 01262

[21] Appl. No.: 356,771

[22] Filed: Dec. 12, 1994

Related U.S. Application Data

[63] Continuation of Ser. No. 38,023, Mar. 29, 1993, abandoned.

[51] Int. Cl.[6] ..... E05D 15/00

[52] U.S. Cl. ..... 16/87.2

[58] Field of Search ..... 16/87.2, 87 R; 160/349.1, 349.2; 4/608, 558

[56] References Cited

U.S. PATENT DOCUMENTS

| | | | |
|---|---|---|---|
| 1,130,362 | 3/1915 | Wogan | 16/87.2 |
| 2,212,326 | 8/1940 | Piken | 4/558 |
| 2,302,341 | 11/1942 | Nash | 16/87.2 |
| 2,601,424 | 6/1952 | Baker | 24/49 |
| 2,864,096 | 12/1958 | Garber | 4/558 |
| 3,000,016 | 9/1961 | Ridge | 4/558 |
| 3,161,929 | 12/1964 | Swett | 16/87.2 |
| 3,529,328 | 9/1970 | Davison | 16/87.2 |
| 3,577,583 | 5/1971 | Amann | 16/87.2 |
| 3,785,003 | 1/1974 | Thomson | 16/87.2 |
| 4,759,087 | 7/1988 | Zeilinger | 16/87.2 |
| 4,903,370 | 2/1990 | Erdmann | 16/87.2 |

*Primary Examiner*—P. Austin Bradley
*Assistant Examiner*—Chuck Y. Mah

[57] ABSTRACT

A curtain holder is disclosed comprising a decorative element for aesthetically embellishing a curtain, and holding means cooperatively engaging the decorative element after the latter has been placed in a preselected location on a curtain or similar fabric. The holding means engages the decorative element in such manner as to grip the curtain material fabric therebetween without penetrating or otherwise disturbing the integrity of the curtain fabric. In the mostly preferred embodiment, the holding means comprises a magnetic member for establishing a magnetic holding circuit including the decorative element.

17 Claims, 4 Drawing Sheets

CURTAIN HOLDER

This application is a continuation of application 08/038,023, filed Mar. 29, 1993, now abandoned.

BACKGROUND OF THE INVENTION

1. Field of the Invention

The present invention relates generally to curtain accessories, and more particularly, to a decorative curtain holder adapted to embellish a curtain and to hold curtain fabric or other material in place in a preselected manner without penetrating the curtain fabric, leaving permanent marks on the curtain fabric, or in any way interfering with the integrity of the curtain fabric or other material.

2. Description of the Prior Art

Decorative devices for embellishing and holding curtains in various prearranged positions generally are known. One such device called a "curtain tie" comprises a band of fabric looped around a curtain panel and drawn tightly to say, one side of a window, and fastened to the wall adjacent the window with a clip or fastener. This well known form of curtain holding device while presenting an attractive appearance is relatively permanent and cannot easily be located with respect to the curtain, i.e. once it is "nailed up" so to speak, it is relatively inconvenient to move or change.

Another known form of curtain retaining accessory comprises a tack which typically consists of a decorative element having a needle sharp tack or "stick pin" extending rearwardly therefrom which latter may be engaged with a cooperating clasp. In use, the curtain fabric is gathered in a desired manner to create a pleasing arrangement and held in place by piercing the fabric material of the gathered curtain with the stick pin and attaching the clasp from behind the curtain. While the curtain stick pin gives the user flexibility by permitting it to be located anywhere throughout the curtain's full extent, the requirement of having the stick pin pierce the curtain material presents the disadvantage of forming undesirable holes in the curtain material.

A long standing need therefore exists for a decorative curtain holder which may be placed anywhere on the curtain, which effectively holds the curtain material in place in a desired manner, but which does not require permanent deformation or localized destruction of the curtain material such as would be the cause if holes were made therein by use of a stick pin. Such a need is completely fulfilled by the present invention. Additional advantages of the present invention over the prior art also will be rendered evident from a further reading of this specification.

SUMMARY OF THE INVENTION

To achieve the foregoing and other advantages, the present invention, briefly described, provides a curtain holder comprising a decorative element for aesthetically embellishing a curtain, and holding means cooperatively engaging the decorative element after the latter has been placed in a preselected location on a curtain or similar fabric. The holding means engages the decorative element in such manner as to grip the curtain material fabric therebetween without penetrating or otherwise disturbing the integrity of the curtain fabric. In the mostly preferred embodiment, the holding means comprises a magnetic member for establishing a magnetic holding circuit including the decorative element.

The above brief description sets forth rather broadly the more important features of the present invention in order that the detailed description thereof that follows may be better understood, mid in order that the present contributions to the art may be better appreciated. There are, of course, additional features of the invention that will be described hereinafter and which will form the subject matter of the claims appended hereto.

In this respect, before explaining several preferred embodiments of the invention in detail, it is to be understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which this disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms of phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved curtain holder which has all of the advantages of the prior art and none of the disadvantages.

It is another object of the present invention to provide a new an improved curtain holder which may be easily and efficiently manufactured and marketed.

It is a further objective of the present invention to provide a new and improved curtain holder which is of durable and reliable construction.

An even further object of the present invention is to provide a new and improved curtain holder which is susceptible of a low cost of manufacture with regard to both materials and labor, and which accordingly is then susceptible of low prices of sale to the consuming public, thereby making such curtain holder available to the buying public.

Still yet a further object of the present invention is to provide a new and improved curtain holder which may be used anywhere on a curtain expanse to hold the curtain fabric or other material in place.

It is still a further object of the present invention is to provide a new and improved curtain holder adapted to locally retain portions of a curtain in place without interfering or otherwise adversely affecting the integrity of the curtain's fabric or other material.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof, Such description makes reference to the annexed drawings wherein.

DESCRIPTION OF THE PREFERRED EMBODIMENT

With reference now to the drawings, a new and improved curtain holder embodying the principles and concepts of the present invention will be described.

Figure 1:
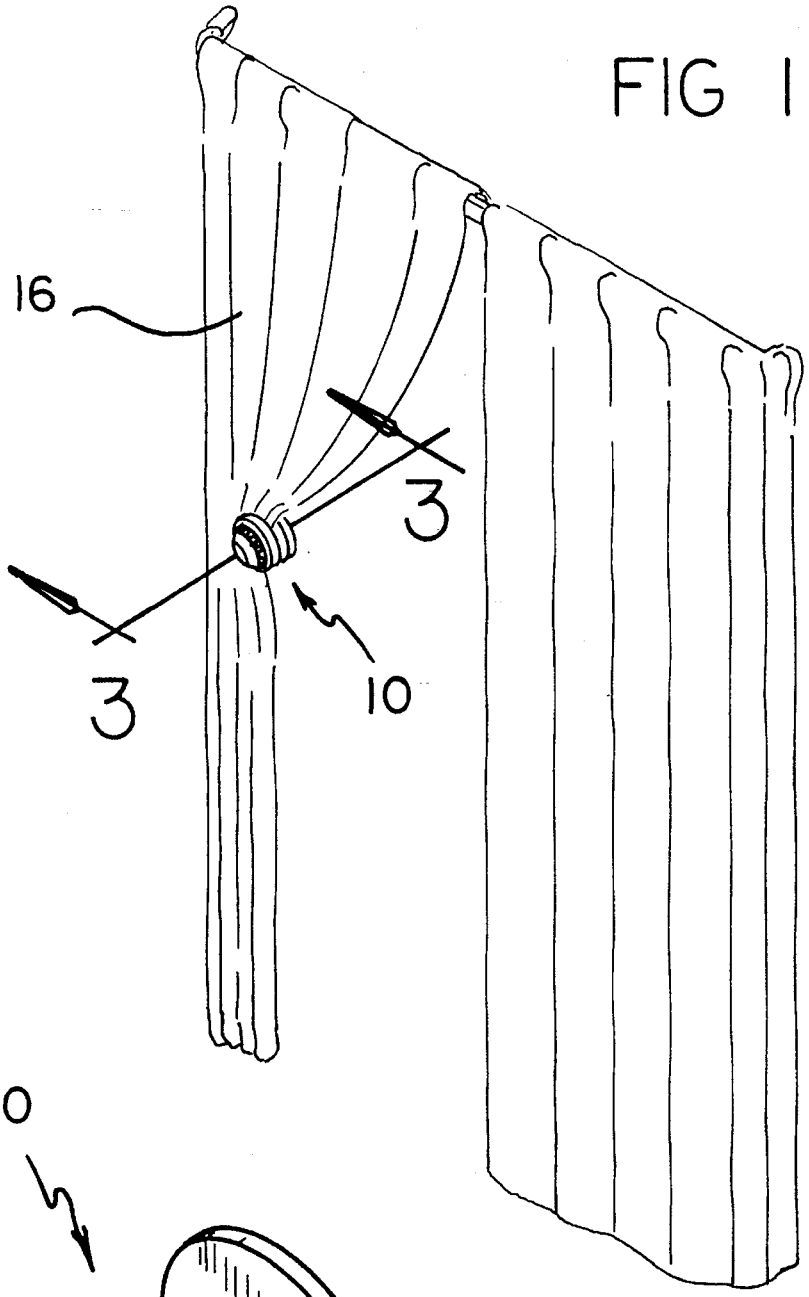
FIG. 1 is a perspective view showing the first preferred embodiment of the curtain holder of the invention in use on a curtain.
Figure 2:
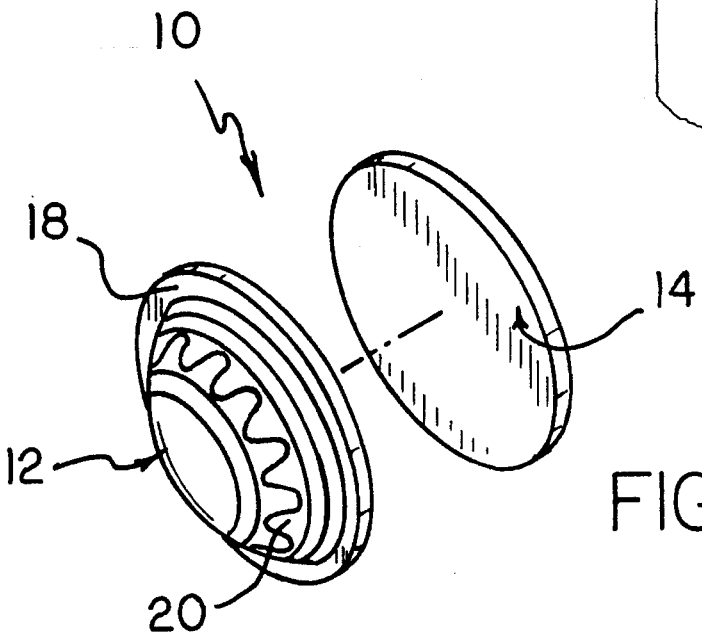
FIG. 2 is a perspective view showing the first preferred embodiment of the curtain holder of the invention before being attached to curtain fabric or material.
Figure 3:
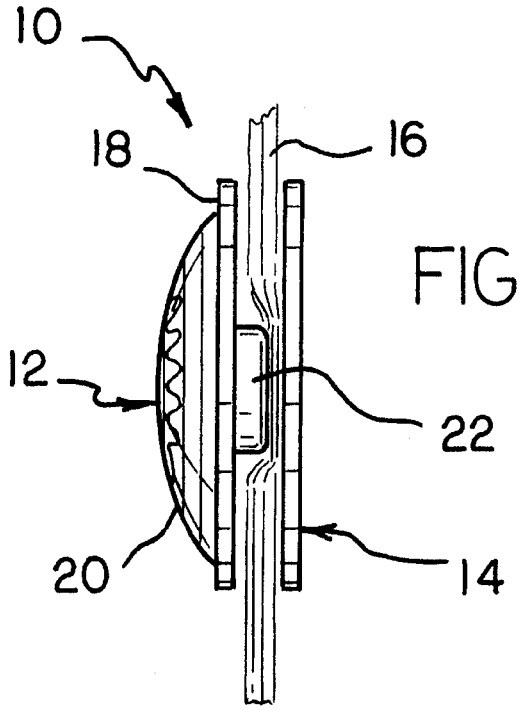
FIG. 3 is a side view of the curtain holder of FIG. 1 taken along line 3—3 thereof.

Turning initially to FIGS. 1–3, there is shown a first exemplary embodiment of the curtain holder of the invention generally designated by reference numeral 10 and comprising a first outwardly facing decorative member 12 and a second rearwardly positioned holding member 14. In accordance with the invention, the decorative member and the holding member are attracted to each other by magnetic force so that when placed in proximity to one another on opposite sides of a curtain fabric or other material 16, the two confronting members 12, 14 will securely grasp each other and the curtain material therebetween and securely retain the curtain material in a desired arrangement such as, for example, pulled to one side substantially as depicted in FIG. 1.

Figure 8:
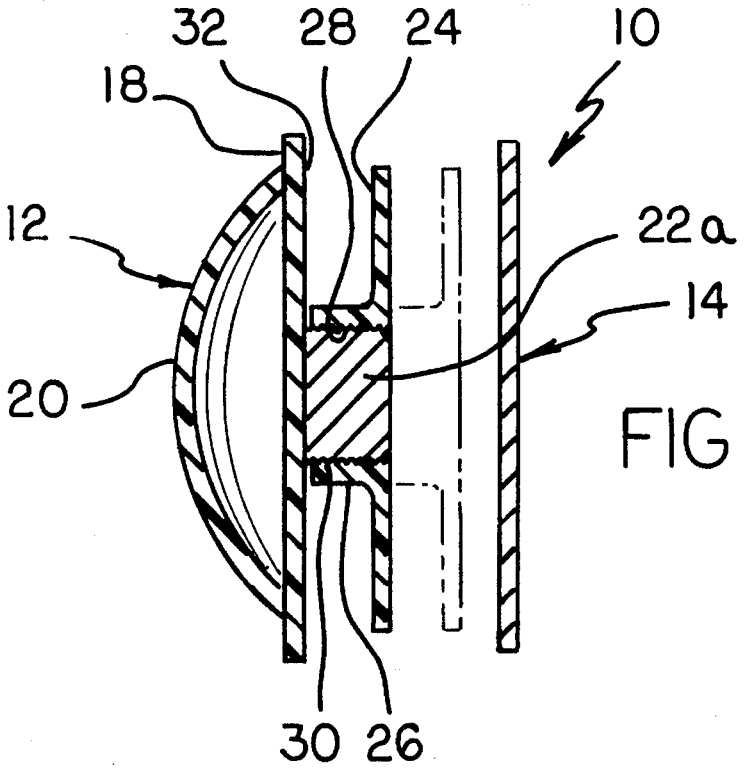
FIG. 8 is a cross-sectional view taken along line 8—8 of FIG. 7.

As shown in FIGS. 2 and 3, the decorative member in its first preferred form comprises a substantially flat, circular member or disc 18 having centrally disposed on its obverse face a hemispherically shaped element or dome 20 formed of a substantially non-ferrous material the surface of which is adorned by a decorative motif or design. As shown in FIG. 8, the hemispherically shaped element or dome 20 is preferably convex in shape along an exterior surface thereof and concave in shape along an interior surface thereof so as to define an unlabeled space between a majority of the interior surface of the hemispherically shaped element and an exterior surface of the circular member or disc 18. The reverse face of disc 18, in turn, has mounted centrally thereon a magnet force generation means most preferably in the form of conventional disc-shaped permanent magnet 22. The space between the interior surface of the hemispherically shaped element and an exterior surface of the circular member or disc 18 thus provides insulation against the magnetic forces generated by the magnet to preclude adherence of ferrous materials to an exterior of the dome. Further, it is desirable that the circular member or disc 18 also be constructed of a substantially non-ferrous material so as to further discourage unintentional adherence of ferrous materials to the device 10.

The holding member 14 is comprised of ferro-magnetic material such as steel or tin and is shaped in the form of a disc having substantially the same dimensions as disc 18. Hence, when decorative member 12 is brought into confronting proximity with holding member 14 on opposite sides of a panel of curtain fabric or material 16 a magnetic path will be established between permanent magnet 22 and ferro-magnetic holding member 14 causing the two parts to be forcibly attracted to each other and to engage each other in an abutting manner with the curtain material 16 therebetween in the fixed relationship shown in FIG. 3. Permanent magnet 22 preferably is affixed to the reverse side of disc 18 by any suitable means most preferably a conventional high strength adhesive applied between the permanent magnet and the disc surface.

It should be understood that in practicing the present invention the magnitude of the attracting or holding force between decorative member 12 and holding member 14 should be great enough to securely hold a gathered curtain panel in place without any shifting of the curtain holder 10 or sagging of the retained curtain material. Generally speaking, the amount of holding force produced will depend upon the strength of the permanent magnet employed, the size and weight of members 12 and 14, and the thickness and weight of curtain fabric being retained in position. Without limiting the present invention, a curtain holder according to the invention successfully has been used to retain a panel of lined curtain material in a pulled back manner (e.g. FIG. 1) wherein the curtain consisted of 4 layers of blended cotton/polyester woven fabric, the decorative element was fabricated from brass and had a diameter of one and half inches, and the permanent magnet was a ceramic magnet #5 (MGOE) having a diameter of 5/16ths inches and a thickness of 3/16ths inches.

Figure 4:
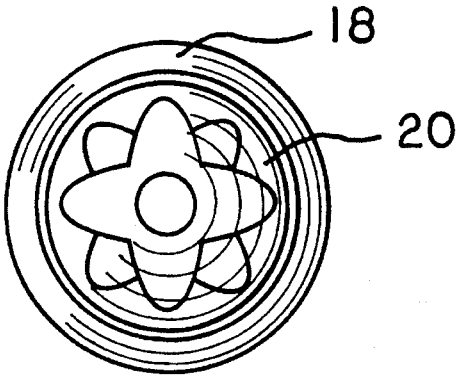
FIG. 4 is a front view of a second preferred embodiment of the invention. having an alternative decorative design.
Figure 5:
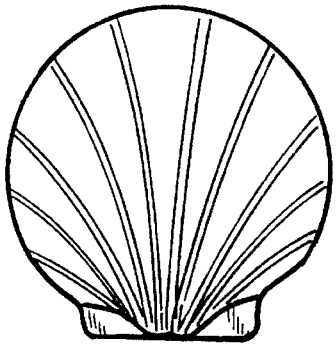
FIG. 5 is a front view of a third preferred embodiment of the invention. having an alternative decorative design.
Figure 6:
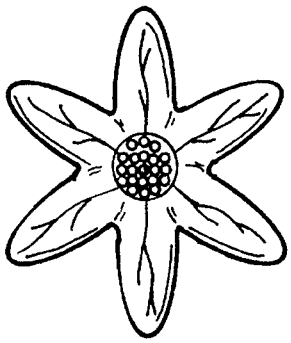
FIG. 6 is a front view of a fourth preferred embodiment of the invention. having an alternative decorative design.

Decorative member 12 may take many different forms without departing from the invention. Thus, as shown in FIG. 4, an alternatively preferred design is used to embellish the surface of dome 20. In FIG. 5, there is shown a still further alternatively preferred form of the invention wherein the dome 20 and the disc 18 are replaced by a convex stamping in the shape, form and design of a sea shell. In this variation, the permanent magnet 22 is affixed directly to the rear surface of the "shell" member. In still yet another alternative form of the invention, illustrated in FIG. 6, the decorative member 12 is in the shape and design of a flower having the permanent magnet 22 affixed to its rear surface. When using a decorative member having an irregular shape such as that shown in FIGS. 5 and 6, the size and shape of the holder member 14 will be reduced or modified accordingly so as not to be visible through a shear curtain panel when the curtain holder is viewed from the front.

Figure 7:
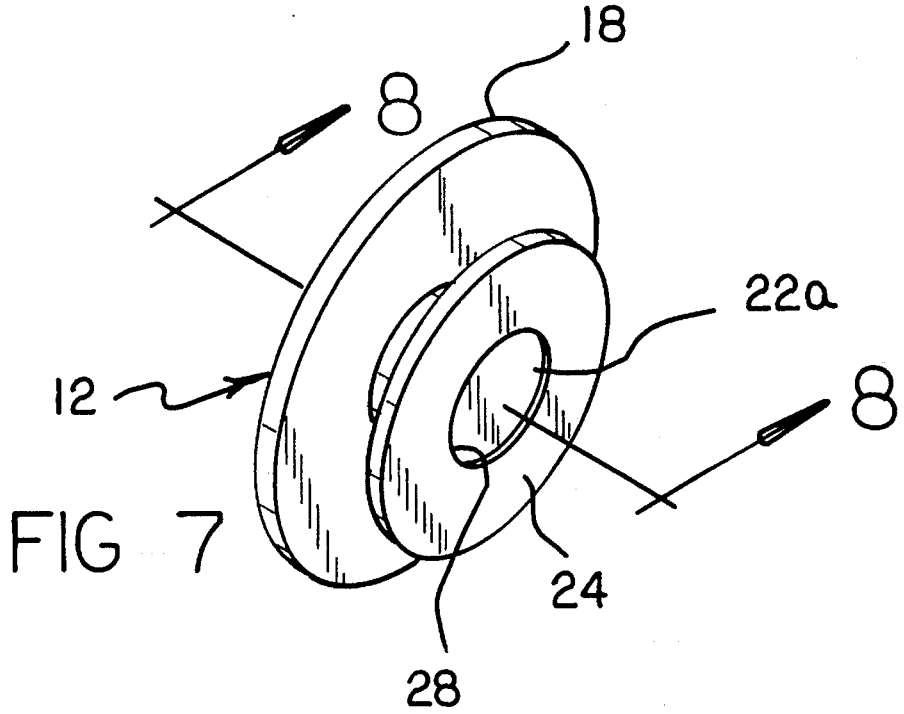
FIG. 7 is a perspective view of a fifth preferred embodiment of the invention having adjustable strength holding means associated therewith.

Turning now to FIGS. 7 and 8, wherein like reference numerals represent like parts already described, there is shown yet another alternatively preferred embodiment of the invention wherein the permanent magnet is in the form of a cylindrical post 22*a* and has associated therewith magnetic force adjustment means for selectively varying the magnet force generated by the permanent magnet. The preferred selectively activatable magnetic force adjustment means is in the form of a disc 24 having a central boss or hub 26 extending from one side thereof as substantially shown. Boss 26 is provided axially with through bore 28 whose surface has a suitable female thread thereon for cooperatively engaging the male threaded surface 30 on the permanent magnet core piece 22*a* affixed centrally to rear side 32 of disc 18 substantially as shown. Disc 24 may be of non-magnetic material or alternatively, may be of ferro-magnetic material.

As a result of the foregoing construction, a larger more powerful permanent magnet may be utilized to retain curtains of heavier fabric or other material. By appropriately rotating the disc 24, it may be caused to axially displace on core piece 22*a* to say, the position indicated by the broken lines in FIG. 8. This action, in turn, will cause a reduction in the magnetic holding force of the permanent magnet inasmuch as holding member 14 will be located further away from the core piece 22*a* in the magnetically engaged position. This would be advantageous, for example, when the curtain holder is used to retain extremely light weight fabric curtains (e.g. so called "shear" curtains) and it is obviously desired not to leave permanent crease marks in the material as might be the case with a stronger than necessary magnetic holding force.

An important advantage of the present invention is the ability of the curtain holder 10 to be positioned any where on a curtain panel to achieve the desired decorative effect since no penetration or permanent alteration of the curtain material is required (e.g. no stick pin holes). Thus, a particular curtain arrangement or ensemble may be changed easily and frequently by merely separating the decorative element 12 from the holding element 14 to thereby break the magnet holding circuit therebetween, moving the parts to another location on the curtain panel, and bringing the parts together in their magnetic cooperative relationship to create a new decorative effect.

Figure 9:
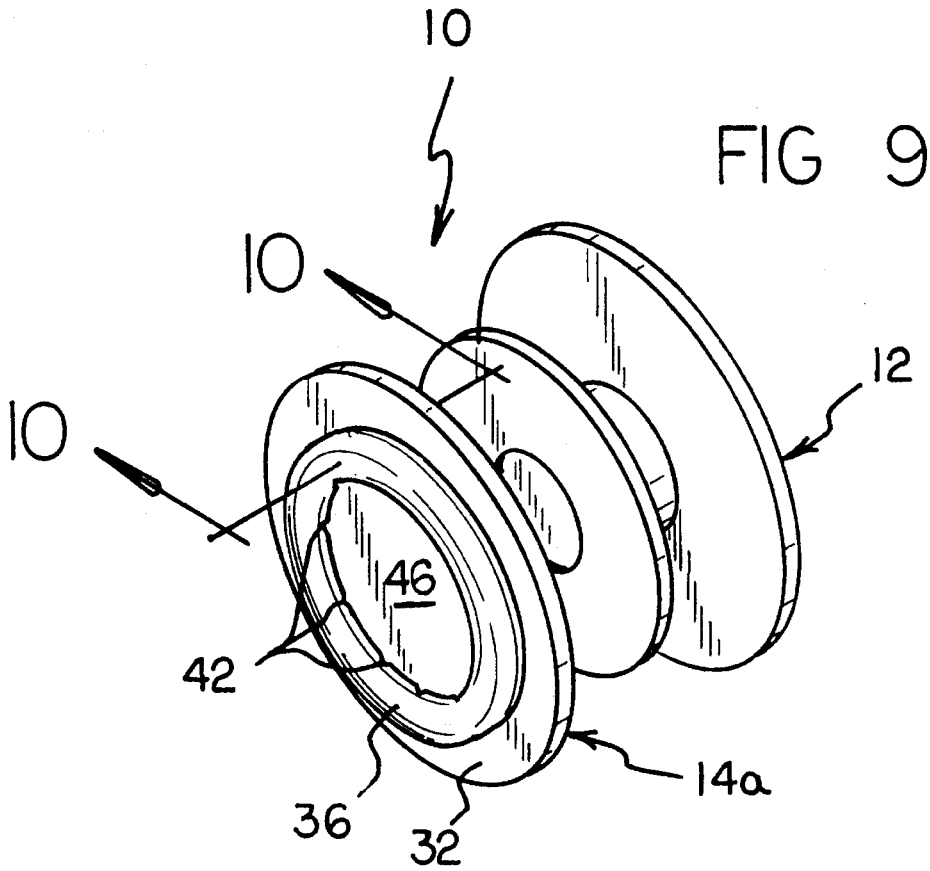
FIG. 9 is a is a perspective view of a sixth preferred embodiment of the invention having wall attachment means associated therewith.
Figure 10:
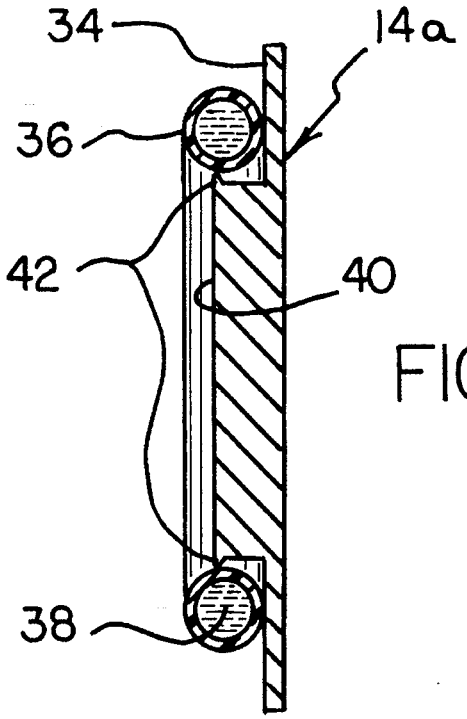
FIG. 10 is a cross-sectional view taken along line 10—10 of FIG. 9.

Notwithstanding the above, the present invention may be modified to include means for permanently locating the decorative curtain holder in a fixed position relative to a curtain panel on say, a wall surface behind the curtain panel. An alternatively preferred embodiment having this additional capability is illustrated in FIGS. 9 and 10 where, again, like reference numerals represent like parts previously disclosed. With reference thereto, holding member 14*a* has centrally disposed on its rear side surface 34 a hollow donut 35 of flexible, rupturable material (e.g. plastic, latex, etc.) The donut is permanently affixed to surface 34 preferably via a conventional adhesive substantially in the relationship shown. The hollow donut has disposed throughout its inside bore a conventional liquid adhesive 38 which when exposed to air will cure and form a strong bond between the surfaces in contact therewith.

In use, the holding member 14*a* is positioned on a supporting surface such as a section of flat wall, for example, and pressure applied against the holding member urging it against the wall's surface, whereupon the donut material will rupture causing the liquid adhesive to flow between surface 32 and the confronting portion of the wall surface. To facilitate easy rupture of donut 36, the rear side 34 of holding member 14*a* is provided with a central extending cylindrical member 40 having a series of sharply pointed, circumferentially spaced projections 42 adapted to perforate donut 36 when the latter is compressed orthogonally relative to the holding member as is believed evident without further description.

Subsequently, drying and curing of the liquid adhesive will create a strong bond between the distal surface 46 of cylindrical member and the confronting wall surface. In this manner, the holding member 14*a* may be affixed securely, and more or less permanently, to a section of wall at a predetermined location behind a curtain panel, and the decorative member 12 brought into cooperative engagement therewith to support the curtain in a preferred arrangement and to achieve a desired aesthetic effect as described above in connection with the prior preferred embodiments of the invention.

In the several preferred embodiments of the invention completely described above in full detail, the magnetic force generation means (e.g. permanent magnets 22, 22*a*) is shown fixed to or otherwise carried on the rear side of the decorative, forward facing member 12. It will be understood however, that the magnetic force means may alternatively be part of, or comprise, the holding member 14 or 14*a* instead of or in addition to being part of or comprising member 12, e.g. it is within the contemplation of the invention to have members 14 or 14*a* comprise the permanent magnet material and have the forward facing decorative member 12 comprise ferro-magnetic material such as steel, tin and so on. Alternatively, both member 12 on the one hand and members 14, 14*a* on the other hand may comprise cooperating permanent magnets or portions thereof as will occur to those of ordinary skill.

It is apparent from the above that the present invention accomplishes all of the objectives set forth by providing a new and improved curtain holder which may be selectively positioned anywhere on a curtain expanse to hold the curtain fabric or other material in place, and further, which is adapted to locally retain portions of a curtain in place without interfering or otherwise adversely affecting the integrity of the curtain's fabric or other material. When the curtain holder is provided with a decorative front facial appearance, an extremely attractive and satisfying curtain embellishment is obtained.

Having described the present invention with the particularity required by statute, it should be realized that the optimum dimensional relationships for the parts of the invention, to include variations in size, materials, shape, form, function and manner of operation, assembly and use, are deemed readily apparent and obvious to those skilled in the art, and therefore, all relationships equivalent to those illustrated in the drawings and described in the specification are intended to be encompassed only by the scope of appended claims.

Moreover, although the present invention has been shown in the drawings and fully described above in detail in connection with what is presently deemed to be the most practical and preferred embodiment(s) of the invention, it will be apparent to those of ordinary skill in the art that many additional modifications alterations thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by Letters Patent of the United States is as follows:

1. An article for holding selected portions of a curtain in a predetermined arrangement comprising:

a first member adapted to be positioned on one side of said curtain, a second member adapted to be positioned on another opposite side of said curtain in a confronting relation to said first member, and holding means for selectively causing said first member to abuttingly engage said second member in a fixed manner with said curtain therebetween without penetrating the material of said curtain, wherein said first and second members are supported in a spaced relationship by said curtain such that direct contact between said first and second members does not occur, wherein said first member comprises a pair of opposed sides, one of said sides having an ornamental design thereon and the other of said sides including said holding means, wherein said second member comprises a substantially flat holding member, and wherein said holding means comprises magnetic force means for magnetically attracting said substantially flat holding member to said other of said sides of said first member with said curtain material therebetween, said second member being of such size and shape as not to be visible when said first member is viewed from said side having said ornamental design thereon.

2. The article of claim 1 wherein said second member comprises a ferrous material and wherein said magnetic force means comprises a permanent magnet.

3. The article defined in claim 2 wherein said permanent magnet is in the form of a disc attached to said other side of said first member and said second member comprises a disc of ferro-magnetic material coextensive with at least said permanent magnet disc.

4. The article defined in claim 1 wherein said second member comprises a permanent magnet and wherein said magnetic force means comprises a ferrous material.

5. The article defined in claim 1 wherein said second member comprises a permanent magnet and wherein said magnetic force means comprises a permanent magnet.

6. The article of claim 1, wherein said ornamental design comprises a hemispherically shaped element fixedly secured to said one of said sides of said first member.

7. The article of claim 6, wherein said hemispherically shaped element is convex in shape along an exterior surface thereof and concave in shape along an interior surface thereof so as to define a space between a majority of the interior surface of the hemispherically shaped element and a majority of an exterior surface of the first member.

8. The article of claim 7 wherein said hemispherically shaped element is constructed of a substantially non-ferrous material.

9. The article of claim 8 wherein said first member is constructed of a substantially non-ferrous material.

10. The article of claim 9 wherein said second member comprises a ferrous material and wherein said magnetic force means comprises a permanent magnet.

11. The article defined in claim 9 wherein said second member comprises a permanent magnet and wherein said magnetic force means comprises a ferrous material.

12. The article defined in claim 9 wherein said second member comprises a permanent magnet and wherein said magnetic force means comprises a permanent magnet.

13. An article for holding selected portions of a curtain in a predetermined arrangement comprising:

a first member adapted to be positioned on one side of said curtain, a second member adapted to be positioned on another opposite side of said curtain in a confronting relation to said first member, and holding means for selectively causing said first member to abuttingly engage said second member in a fixed manner with said curtain therebetween without penetrating the material of said curtain, wherein said first member comprises a pair of opposed sides, one of said sides having an ornamental design thereon and the other of said sides including said holding means, wherein said holding means comprises magnetic force means for magnetically attracting said second member, and wherein said second member comprises a ferrous material adapted to be attracted by said magnetic force means, further including magnetic force adjustment means adjustably mounted to the magnetic force means for selectively varying the magnet force exerted between said magnetic force means and said second member.

14. The article defined in claim 13 wherein said magnetic force means comprises a magnetic post extending from said other side of said first member, and further wherein said magnetic force adjustment means for selectively varying the magnet force generated by said magnetic force means comprises a disc adjustably and movably mounted on said post.

15. A new and improved article for holding selected portions of a curtain in a predetermined arrangement comprising:

a first member adapted to be positioned on one side of said curtain, a second member adapted to be positioned on another opposite side of said curtain in a confronting relation to said first member, and holding means for selectively causing said first member to abuttingly engage said second member in a fixed manner with said curtain therebetween without penetrating the material of said curtain, wherein said first member comprises a pair of opposed sides, one of said sides having an ornamental design thereon and the other of said sides includes said holding means, wherein said holding means comprises magnetic force means for magnetically attracting said second member, and wherein said second member comprises ferro magnetic material adapted to be attracted by said magnetic force means, further including mounting means for permanently locating said second member on a surface proximal to said curtain, and wherein said mounting means comprises activatable adhering means mounted on said second member, said adhering means comprising a flexible, rupturable container, and liquid adhesive means disposed in said container.

16. A method of arranging a curtain comprising the steps of:

(a) providing the article of claim 1, (b) arranging a portion of said curtain in a first predetermined manner, (c) positioning said article on said curtain arranged in said first predetermined manner with a first portion of said curtain between said first and second members, and (d) moving said first and second members into engagement with each other with said first portion of said curtain captured therebetween, wherein said article is not supported by an adjacent structure so as to freely hang from said curtain.

17. The method of arranging a curtain of claim 16, and further comprising the steps of:

(e) releasing the first and second members from each other;

(f) arranging said curtain in a second predetermined manner;

(g) positioning said article on said curtain arranged in said second predetermined manner with a second portion of the fabric of said curtain between said first and second members, and (h) moving said first and second members into engagement with each other with said second portion of said curtain material captured therebetween, wherein said article is not supported by an adjacent structure so as to freely hang from said curtain.

* * * * *